US005366058A

United States Patent [19]

Kurosu

[11] Patent Number: 5,366,058

[45] Date of Patent: Nov. 22, 1994

[54] COIN SELECTOR AND SELECTION METHOD FOR COIN-OPERATED MACHINES FOR DETECTING FRAUD IN COIN INSERTION

[75] Inventor: Makoto Kurosu, Tokyo, Japan

[73] Assignee: Kabushiki Kaisha Universal, Oyama, Japan

[21] Appl. No.: 992,435

[22] Filed: Dec. 17, 1992

[30] Foreign Application Priority Data

Dec. 17, 1991 [JP] Japan ..... 3-333444

[51] Int. Cl.[5] ..... G07D 5/08

[52] U.S. Cl. ..... 194/202; 194/317

[58] Field of Search ..... 194/200, 202, 203, 317, 194/318, 319, 217, 218; 453/17, 32; 377/7

[56] References Cited

U.S. PATENT DOCUMENTS 4,429,407 1/1984 Furuya ..... 377/7

4,558,712 12/1985 Sentoku et al. ..... 453/3

*Primary Examiner*—F. J. Bartuska

*Attorney, Agent, or Firm*—Young & Thompson

[57] ABSTRACT

A coin selector has a coin passageway wherein coins are inserted. A magnetic sensor inspects the coins in the coin passageway, and generates an inspection signal, which a controller evaluates to generate an acceptance or rejection signal. A gate plate responds to the acceptance or rejection signal, and selectively provides access to one of two chutes for the inspected coins, namely, an accepting chute for acceptable coins and a return chute for unacceptable coins. A photo sensor detects the acceptable coins in the accepting chute, and generates a detection signal. Counters are adapted to count the acceptance signals incrementally and the detection signals decrementally. A controller adds together the two counts of the counters, evaluates the sum of this addition, and generates an error signal in accordance with the sum evaluation. The error signal is utilized for the detection of fraud.

30 Claims, 6 Drawing Sheets

COIN SELECTOR AND SELECTION METHOD FOR COIN-OPERATED MACHINES FOR DETECTING FRAUD IN COIN INSERTION

BACKGROUND OF THE INVENTION

1. Field of the Invention

The present invention relates to a coin selector and selection method for coin-operated machines for detecting fraud in coin insertion. More particularly, the present invention relates to a coin selector applied to a coin-operated machine such as a gaming machine, and relates also to an error detecting method to detect fraud in coin insertion through the same selector.

2. Description of the Prior Art

A coin-operated machine is operated in response to insertion of coins, tokens, medals or other disks (herein referred to as coins) into a coin inlet or passageway. Such coin-operated machines include slot machines, other gaming machines, vending machines and money-changing machines. In a slot machine for example, an acceptable coin must be selected before a game can begin, in order to prevent the machine from operating by insertion of a slug or unacceptable coin different from the genuine acceptable coin of a predetermined denomination.

To automate the selection of acceptable coins for the slot machine, there has been proposed a coin selector as illustrated in FIG. 6. In this conventional coin selector, a coin 9 is sensed through an inlet slot of the slot machine and passed along a coin passageway 10, which communicates both with an accepting chute 11 and a return chute 12. The coin 9 is detected twice: by a magnetic sensor 13 and by a photo sensor 14. A gate 15 is swingable between a position wherein the coin 9 from the passageway 10 is passed to the accepting chute 11, shown in phantom line in FIG. 6, and another position wherein the coin 9 is passed to the return chute 12 shown in full line in FIG. 6.

An inspection signal of the coin 9 is sent from the magnetic sensor 13 to a controller 16, and is evaluated as to whether it represents an acceptable or unacceptable coin. When the coin 9 is acceptable, the plate 15 is moved to the accepting position by actuation of a solenoid 17, so as to guide the acceptable coin 9 into the accepting chute 11. The acceptable coin 9 then passes the photo sensor 14 to cause it to output a detection signal to the controller 16, which evaluates the detection signal as to effectiveness. To conduct the latter evaluation, the controller 16 judges a time period T1 which begins with inspection signal and ends with the detection signal. When the detection signal is judged as effective, the controller 16 actuates a slot machine mechanism 18. The player can play games corresponding to the number of coins inserters.

The conventional coin selector, however, suffers from the disadvantage of being vulnerable to fraud by use of a tool as illustrated in FIG. 7, enabling a player to play games without paying coins. A celluloid plate 19 of the tool is crooked in correspondence with the inside of the passageway 10, and is provided with three slots 19*a* to 19*c* in positions corresponding to the downstream sensor 14. An acceptable coin 9 as a decoy is secured to the celluloid plate 19 in the position corresponding to the upstream sensor 13. The coin 9 is evaluated as acceptable by the sensor 13 and the controller 16. The slots 19*a* to 19*c* are detected by the photo sensor 14, and cause the controller 16 to generate three detection signals before the lapse of time T1 from the sensing of the coin 9 by the sensor 13, and are evaluated as effective three times. One use of the celluloid plate 19 thus enables the user to play three games without actually paying any coins.

OBJECT OF THE INVENTION

In view of the foregoing problems, an object of the present invention is to provide a coin selector for a coin-operated machine in which the machine can be protected from fraud with the provision of no further mechanical structure, and to provide an error detecting method for coin supply through the same selector.

SUMMARY OF THE INVENTION

In order to achieve the above and other objects and advantages of this invention, a novel coin selector selects acceptable and unacceptable coins from coins inserted into a coin passageway. An accepting chute is arranged downstream from the coin passageway for passing acceptable coins. A return chute is arranged downstream from the coin passageway for returning unacceptable coins. An upstream sensor is arranged in the coin passageway for inspecting the coins that pass through the coin passageway in order to generate an inspection signal. Judging means evaluates the inspection signal in order to generate an acceptance signal for acceptable coins and a rejection signal for unacceptable coins. Gate means provide the accepting chute with the inspected coins that passed through the coin passageway when the acceptance signal is generated, and provides the return chute with the inspected coins when the rejection signal is generated. A downstream sensor detects the acceptable coins that passed through the accepting chute in order to generate a detection signal. A first counter counts the acceptance signals. A second counter counts the detection signals. Control means process the counts of the first and second counts, and evaluate the processed result of the counts, and generate an error signal in accordance with the evaluation of the processed result.

In accordance with the present invention, the coin-operated machine provided with the novel coin selector can thus be protected from possible fraud. No change or alteration of the mechanical structure of a conventional selector is required for constructing the novel coin selector. All that is needed is a change in circuitry.

BRIEF DESCRIPTION OF THE DRAWINGS

The above and other objects and advantages of the present invention will become more apparent from the following detailed description when read in connection with the accompanying drawings, in which.

DETAILED DESCRIPTION OF THE PREFERRED EMBODIMENTS

Figure 1:
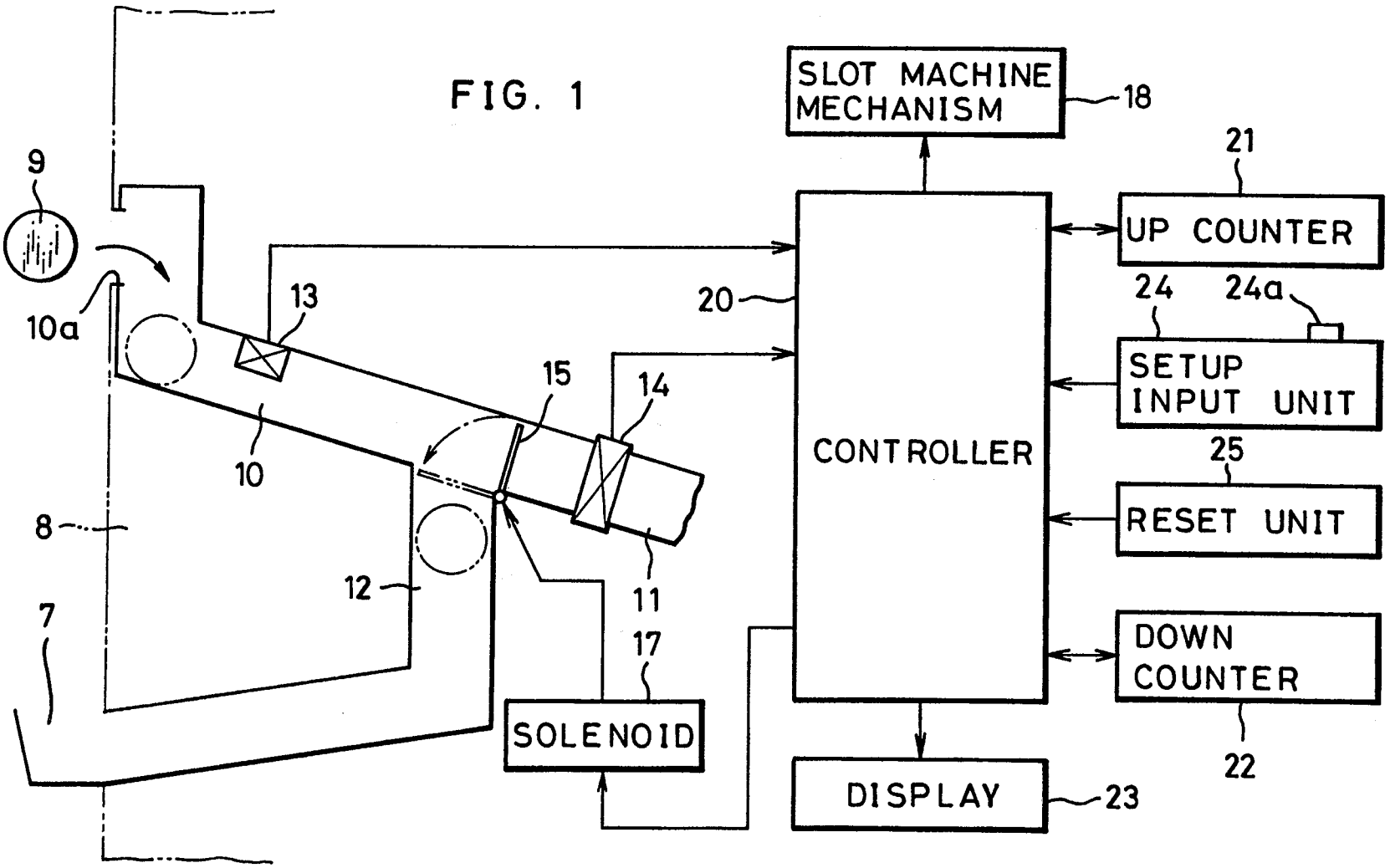
FIG. 1 is a schematic view illustrating a novel coin selector; according to the invention

In FIG. 1 illustrating a novel coin selector according to the present invention, a coin passageway 10, into which a coin 9 is inserted through an inlet slot 10*a* of a slot machine 8, communicates both with an accepting chute 11 and a return chute 12. The chutes 11 and 12 further communicate with a hopper device (not shown) of the slot machine 8 and a coin tray or outlet 7, respectively. Respective reels of the slot machine 8 are rotated by the slot machine mechanism 18, and the reels are stopped automatically or by manual operation of stop buttons. If the reels are stopped to show a combination of symbols in a window as predetermined for a win, then the slot machine mechanism 18 causes the hopper device to pay out a predetermined number of coins into the coin tray 7. If the novel coin selector is used on a vending machine or the like, the accepting chute 11 communicates with a cash box instead of a hopper device.

Inside the passageway 10 is a magnetic sensor 13. Inside the accepting chute 11 is a photoelectric sensor or photo sensor 14. There is a gate plate 15 where the passageway 10 branches to the chutes 11 and 12. The plate 15 is swingable between an accepting position shown in phantom lines in FIG. 1 wherein the coin 9 is allowed to pass from the passageway 10 to the accepting chute 11, and a rejecting position shown in full lines in FIG. 1 wherein the coin 9 is deflected from the passageway 10 into the return chute 12.

The magnetic sensor 13 is constituted of an oscillator and a receiver which are arranged face to face. When the coin 9 passes between the oscillator and the receiver, the receiver of the sensor 13 generates an inspection signal having such voltage that the wave of the signal corresponds to the material and diameter of the coin 9. A controller 20 receives the inspection signal from the magnetic sensor 13, and evaluates the material and the diameter of the coin 9 so as to generate an acceptance or rejection signal for the inspected coin 9. The material of the coin 9 is detected according to the waveform of the inspection signal, whereas the diameter of the coin 9 is detected according to the width of the inspection signal. When and only when both the material and the diameter of the coin 9 are judged to be acceptable from the evaluation of the inspection signal, a solenoid 17 is actuated for a predetermined period of time. Upon actuation of the solenoid 17, the plate 15 is moved to the accepting position so as to guide the acceptable coin 9 into the accepting chute 11. When the coin 9 is judged to be unacceptable by the magnetic sensor 13 and the controller 20, the solenoid 17 is inactive and keeps the plate 15 in the returning position, so that the unacceptable coin is dropped into the return chute 12. The controller 20 also controls relevant circuits of a slot machine mechanism 18.

The photo sensor 14 is constituted of a light projector and a light receiver sandwiching between them the inside of the accepting chute 11, and generates a detection signal upon passage of the coin 9 therethrough. The detection signal from the photo sensor 14 is entered in the controller 20, which evaluates the detection signal as to effectiveness. To conduct this evaluation, the controller 20 judges a time period which begins at the inspection signal and ends at the detection signal corresponding thereto.

Figure 2:
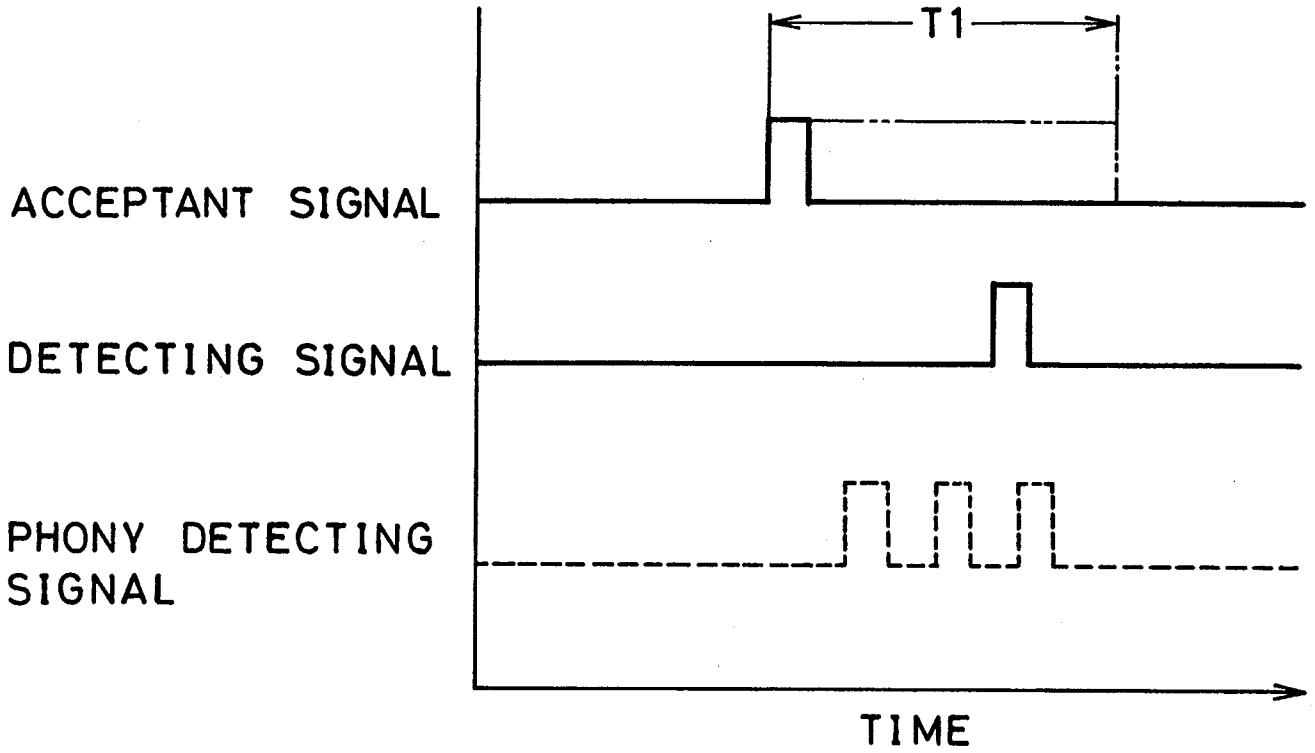
FIG. 2 is a timing chart illustrating an acceptable inspection signal obtained from a magnetic sensor and a detection signal from a photo sensor.

As illustrated in FIG. 2, a reference time period T1 is predetermined in correspondence both with the interval between the sensors 13 and 14 and with the expected velocity of the coin 9 passing between the sensor 13 and 14. It is judged that the detection signal from the photo sensor 14 is effective when it is generated within the range of time T1 from the inspection signal of the magnetic sensor 13, and is ineffective when it is generated after the lapse of time T1 from the inspecting signal of the magnetic sensor 13.

Note that the waveform indicated with the broken line in FIG. 2 represents three pulses within T1. These pulses would be generated by the three slots 19*a* to 19*c* of the celluloid plate 19 (see FIG. 7) fraudulently used to cause the downstream sensor 14 mistakenly to sense that three coins were accepted.

While the controller 20 evaluates the inspection signal from the magnetic sensor 13, an up counter 21 counts the number of the acceptable coins 9 passing the magnetic sensor 13 in accordance with the acceptance inspection signals. The initial value of the up counter 21 is for example zero. Acceptance signals are counted in the up counter 21 in such increments as 1, 2, 3, and so on. When the detection signal from the photo sensor 14 is entered in the controller 20, a down counter 22 counts the number of the acceptable coins 9 passing through the accepting chute 11 in accordance with the detection signal from the photo sensor 14. The initial value of the down counter 22 for example zero. Detecting signals are counted in the down counter 22 in such decrements as −1, −2, −3, and so on.

The controller 20 is connected to both counters 21 and 22, and adds up the counts obtained in the counters 21 and 22. Let C1 be the count of the up counter 21, and C2 be the count of the down counter 22. The controller 20 constantly monitors the sum of the addition of C1 and C2. Normally, the sum as stabilized of C1 and C2 equals zero, or nearly equals zero. When the controller 20 judges that the sum C1+C2 is unequal to or somewhat different from zero, an error signal is generated by the controller 20.

Suppose that the error signal will be generated whenever the sum in unequal exactly to zero. A frequently occurring situation, which would be regarded as an error, is when the time interval between the inspection at the sensor 13 and the detection at the sensor 14 is slightly irregular within an allowable small range. In view of this, it is desirable to predetermine such a small range on both sides of zero so as to evaluate the sum of C1 and C2 without generating an error signal, as will be described later in detail. When an error signal is generated, operation of the relevant mechanism 18 of the slot machine 8 is stopped and the controller 20 causes a display device 23 to display a warning indication to a player or user.

To the controller 20 are connected a setup input unit 24 and a reset unit 25. The setup input unit 24 is manually operable to input values to predetermine the above small range straddling zone. A changeover switch 24*a* is operated to select either the normal mode or a setup input mode. In the setup input mode, through the switch 24*a*, upper and lower limits of the mentioned small range are inputted to the controller 20. The reset unit 25 is manually operable to reset the relevant mechanism 18 and the coin selector including the display 23, when the relevant mechanism 18 is stopped and the warning indication is displayed in the display 23.

Figure 3:
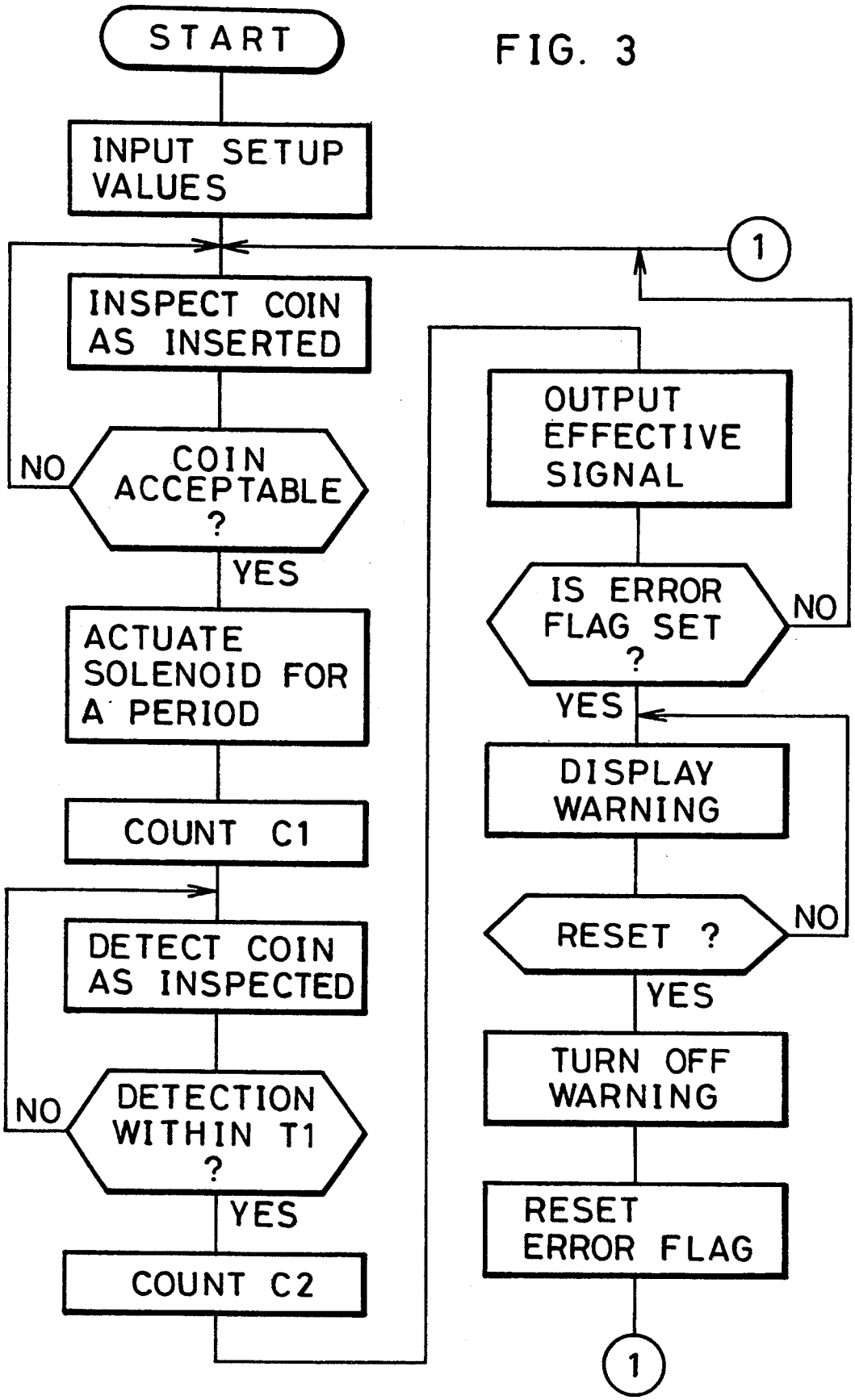
FIG. 3 is a flow chart illustrating a main routine of the coin selector.
Figure 4:
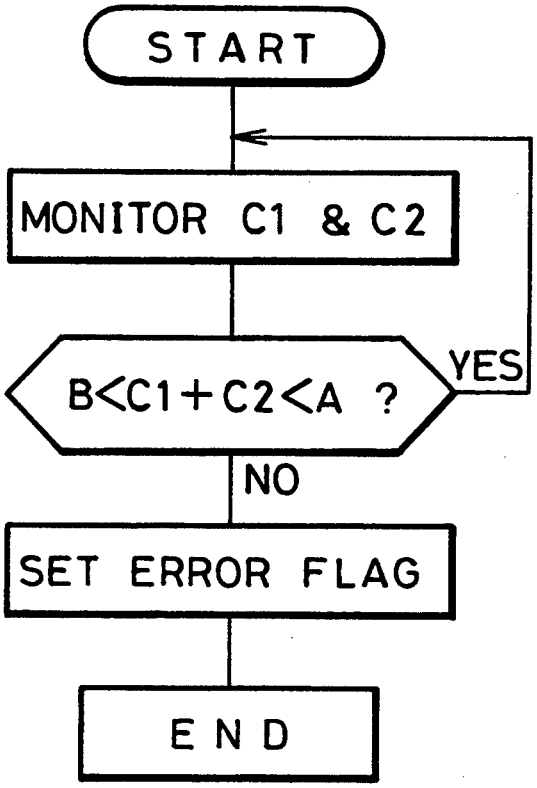
FIG. 4 is a flow chart illustrating a routine for detecting an error in supply of coins.
Figure 5:
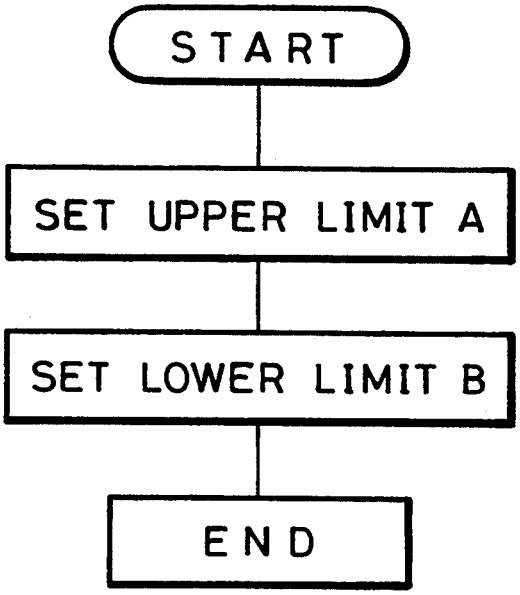
FIG. 5 is a flow chart illustrating a routine for inputting a setup of an allowable range.
Figure 6:
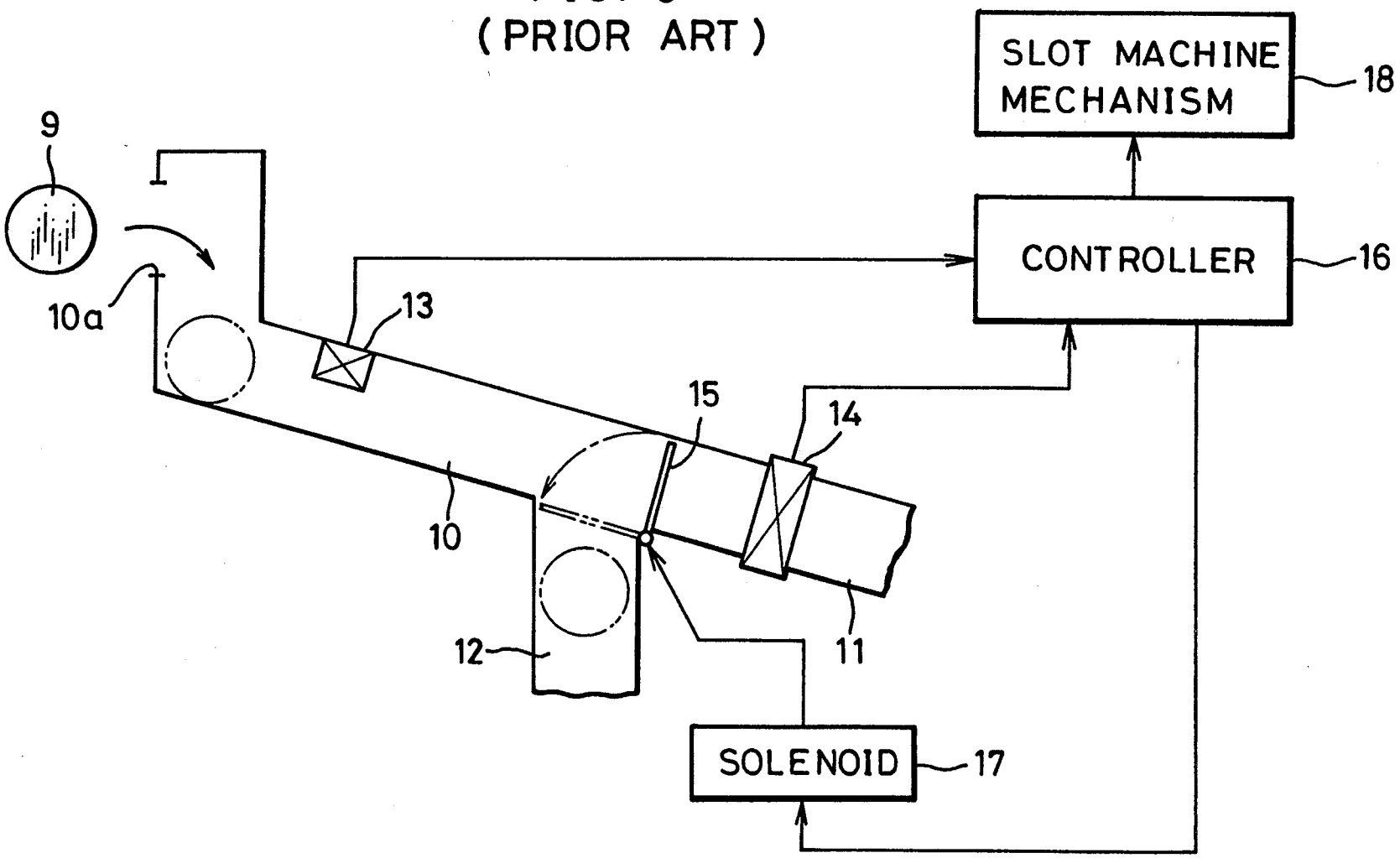
FIG. 6 (PRIOR ART)
FIG. 6 is a schematic view illustrating a conventional coin selector.

The operation of the coin selector will now be described with reference to the flow charts of FIGS. 3 to 5. The setup input mode is selected through the changeover switch 24*a*. The upper limit A and the lower limit B for the sum of cl and C2 of the counters 21 and 22 are entered as intended by an operator, before selecting the normal mode again through the changeover switch 24*a*. The coin selector is then ready for insertion of a coin 9 into the slot machine 8.

The coin 9 is inserted through an inlet slot 19*a* and passes the magnetic sensor 13, which generates an inspection signal representing information as to the material and diameter of the coin 9. The inspection signal is evaluated by comparison with the reference information previously entered in the controller 20. When the coin 9 is judged acceptable, then the solenoid 17 is actuated for a predetermined period to place plate 15 in a lowered position to guide the coin 9 to the accepting chute 11. In response to one acceptable coin identified by the inspection signal, the controller 20 outputs one pulse as an acceptance signal to the up counter 21 to cause it to count the coin 9 that has passed the magnetic sensor 13.

The coin 9 passes through the photo sensor 14 afterwards. The photo sensor 14 generates a detection signal upon each passage of a coin 9. The detection signal is evaluated by the controller 20 to be effective or ineffective. The evaluation, as seen in FIG. 2, judges the detection signal as effective when the detection signal is generated at or before the lapse of time T1 after the generation of the acceptable inspection signal. Only when effectiveness is thus judged by evaluation, does the controller 20 send the effective signal to the slot machine mechanism 18. The controller 20 outputs the effective signal to the down counter 22, which is caused to count the coins 9 that have passed through the photo sensor 714. After generation of the effective signal, it is judged whether an error flag has been set or not. When and only when no error flag exists, does the flow return to the initial routine.

The controller 20 constantly monitors the sum C1+C2 according to the counters 21 and 22 with reference to the upper and lower limits A and B as determined through the setup input unit 24. When C1+C2 becomes A or over A, or B or below B. then an error flag is set. Setting of the error flag causes the display 23 to show a warning indication, and stops the slot machine mechanism 18.

Suppose that it is determined, for example, that A is 5 and B is −2. Suppose all the inserted coins have been determined to be acceptable. Upon passage of the coins 9 past the magnetic sensor 13, C1 of the up counter 21 is changed to be 1, 2, 3 and so on. Before passage of the coins 9 through the photo sensor 14, C2 of the down counter 22 is still zero. Upon passage of the coins 9 through the photo sensor 14, C2 is changed to be −1, −2, −3 and so on. Each coin 9 passes from the sensor 13 to the sensor 14 during a period of time of 100 msec or less, during which C1+C2 increases 1, 2, 3 and so on initially. After the coins 9 have passed through the photo sensor 14, C1+C2 decreases to 3, 2, 1 until it becomes zero in a stable condition.

In brief, successive insertion of the coins 9 brings C1+C2 temporarily to more than zero. Note that the passageway 10 and the accepting chute 11 are so shaped that there can be a small number of coins, e.g. two or three, which have passed the upstream sensor 13 but not yet the downstream sensor 14, during their passage through the coin selector. The sum C1+C2 corresponds to the number of the successive coins running between the sensors 13 and 14, but is allowed to be only below the upper limit A. No error flag is set within the allowed range below A, except for an accidental state such that too many coins back up and jam between the sensors 13 and 14. In view of this, A is determined preferably to be 3, 4, 5, or the like.

Figure 7:
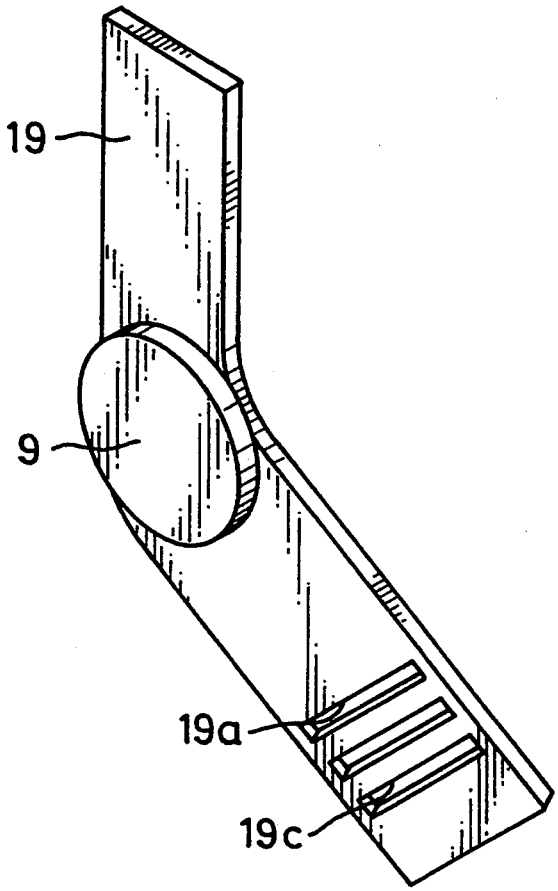
FIG. 7 (PRIOR ART)
FIG. 7 is a perspective view illustrating a tool for fraudulently operating a conventional coin selector.

On the contrary, there is no possibility for honest players that C1+C2 should fall below zero. When C1+C2 is −2 or below, the warning indication is immediately displayed upon setting the error flag, because C1+C2 of at most −2 implies that fraud has been practiced by use of a tool as illustrated in FIG. 7, which is the only way to cause the downstream sensor 14 to generate three effective signals almost at once. Determination of B as −2 could be somewhat tolerant toward cheaters, because it allows acceptance of only one unacceptable coin. Alternatively, B may be predetermined to be −1 so that a cheater can be discovered and dealt with immediately upon committing fraud.

The present invention is also advantageous for preventing another way of fraudulent play, by using an acceptable decoy coin and a thread for suspending the coin. In a conventional coin selector, a cheater could insert the suspended coin to the position of the upstream sensor 13, actuate the sensor 13 to lower the swingable plate 15, and insert plural slugs through the passageway 10 into the accepting chute 11. But with the present invention, such cheating can be discovered easily, because C1+C2 then fails below zero.

Although the coin 9 is inspected by the magnetic sensor 13 and detected by the photo sensor 14 according to the present embodiment, yet two sensors of other construction as well-known in the art may be adapted to inspection and detection of the coin 9. Although the count C1 of the up counter 21 and the count C2 of the down counter 22 are added together in the present embodiment, yet two up counters may be used and their counts may be subtracted one from another. Two down counters may be used and their counts may be subtracted one from another. Although the coin selector as described according to the above embodiment is used in the slot machine 8, the coin selector may also be applied in other gaming machines, vending machines, money-changing machines, or coin-operated machines of any kind, for use with a predetermined denomination of coin, token, medal or other disk.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A coin selector for selecting acceptable and unacceptable coins from among coins inserted into a coin passageway, comprising:

an accepting chute arranged downstream from said coin passageway for passing said acceptable coins;

a return chute arranged downstream from said coin passageway for returning said unacceptable coins;

an upstream sensor arranged in said coin passageway for inspecting coins that pass through said coin passageway in order to generate an inspection signal;

judging means for evaluating said inspection signal in order to generate acceptance signals for said acceptable coins and rejection signals for said unacceptable coins;

gate means for providing said accepting chute with said inspected coins that have passed through said coin passageway when said acceptance signals are generated, and for providing said return chute with said inspected coins when said rejection signals are generated;

a downstream sensor for detecting said acceptable coins that have passed through said accepting chute in order to generate detection signals;

a first counter for counting said acceptance signals;

a second counter for counting said detection signals; and control means for processing the counts of said first and second counters, for evaluating a processed result of said counts, and for generating an error signal in accordance with said evaluation of said processed result.

2. A coin selector as defined in claim 1, wherein said error signal is generated when said detection and inspection signals differ sufficiently to indicate fraudulent use.

3. A coin selector as defined in claim 1, wherein said upstream sensor senses at least a diameter of said coins.

4. A coin selector as defined in claim 3, wherein:

said upstream sensor is a magnetic sensor and further senses material of said coins; and said downstream sensor is a photoelectric sensor.

5. A coin selector as defined in claim 1, wherein said gate means closes said return chute when said acceptance signals are generated, and closes said accepting chute when said rejection signals are generated.

6. A coin selector as defined in claim 1, which is incorporated in a coin-operated machine, which is stopped from operating when said error signal is generated.

7. A coin selector as defined in claim 1, wherein:

said first counter counts said acceptance signals incrementally;

said second counter counts said detection signals decrementally;

said processed result of said control means is a sum of said counts; and said control means generates said error signal when said sum is equal to or less than a predetermined reference value.

8. A coin selector as defined in claim 7, wherein said reference value is a small negative integer.

9. A coin selector as defined in claim 8, wherein said reference value is $-2$.

10. A coin selector as defined in claim 7, wherein said control means also generates said error signal when said processed result is equal to or more than a second predetermined reference value which is positive, whereby the passage of an acceptable coin through said coin passageway without corresponding detection in said accepting chute indicates possible jamming of said coins.

11. A coin selector as defined in claim 10, wherein said reference value is determined in consideration of a normal time interval of travel of acceptable coins between said upstream and downstream sensors.

12. A coin selector as defined in claim 1, wherein said control means further monitors the time of generation of said inspection and detection signals and allows said second counter to count when said detecting signals are generated within a predetermined time period after said inspection signals.

13. A coin selector as defined in claim 6, wherein said coin-operated machine is a slot machine.

14. A coin selector as defined in claim 1, wherein said gate means includes a swingable plate and a solenoid for swinging said plate in response to said acceptance and rejection signals from said control means.

15. A coin selector as defined in claim 1, further comprising display means for externally displaying a warning indication in response to generation of said error signal by said control means.

16. A coin selector as defined in claim 6, further comprising resetting means for resetting said coin-operated machine after said machine has been stopped by said error signal from operating.

17. A method for selecting acceptable and unacceptable coins from among coins inserted into a coin passageway of a coin selector including an accepting chute arranged downstream from said coin passageway for passing said acceptable coins and a return chute arranged downstream from said coin passageway for returning said unacceptable coins;

the method comprising the steps of:

inspecting said coins that pass through said coin passageway and generating an inspection signal;

evaluating said inspecting signal and generating acceptance signals for said acceptable coins and rejection signals for said unacceptable coins;

providing said accepting chute with only said inspected coins that pass through said coin passageway when said acceptance signals are generated;

providing said return chute with only said inspected coins when said rejection signals are generated;

detecting said acceptable coins that pass through said accepting chute in order to generate a detection signal;

counting said acceptance signals;

counting said detection signals;

processing the counts of said acceptance signals and said detection signals;

evaluating the processed result of said counts; and generating an error signal in accordance with said evaluation of said processed result.

18. An error detecting method as defined in claim 17, wherein said error signal is generated when said detection and inspection signals differ sufficiently to indicate fraudulent use.

19. An error detecting method as defined in claim 17, and closing said return chute when said acceptance signals are generated, and closing said accepting chute when said rejection signals are generated.

20. An error detecting method as defined in claim 17, wherein said coin selector is incorporated in a coin-operated machine, and stopping said coin-operated machine from operating when said error signal is generated.

21. An error detecting method as defined m claim 17, wherein:

said acceptance signals are counted incrementally;

said detection signals are counted decrementally;

said processed result of said counts is a sum thereof; and said error signal is generated when said sum is equal to or less than a predetermined reference value.

22. An error detecting method as defined in claim 21, wherein said reference value is a small negative integer.

23. An error detecting method as defined in claim 21, wherein said error signal is also generated when said processed result is equal to or more than a second predetermined reference value which is positive, whereby the passage of an acceptable coin through said coin passageway without corresponding detection in said accepting chute indicates possible jamming of said coins.

24. An error detecting method as defined in claim 17, wherein said reference value is determined in consideration of a normal time interval of travel of acceptable coins between positions wherein said coins are inspected in said coin passageway and detected in said accepting chute.

25. An error detecting method as defined in claim 17, comprising a further step of monitoring the time of generation of said inspection and detection signals and allowing counting of said detection signals when said detection signals are generated within a predetermined time period after said inspection signals.

26. An error detecting method as defined in claim 17, practiced in a coin-operated machine.

27. An error detecting method as defined in claim 17, and swinging a plate arranged downstream from said coin passageway and upstream from both said chutes so as selectively to provide either of said chutes with said inspected coins that pass through said coin passageway.

28. An error detecting method as defined in claim 17, comprising a further step of displaying a warning indication externally of said coin selector in response to generation of said error signal.

29. An error detecting method as defined in claim 26, comprising a further step of resetting said coin-operated machine after said machine has been stopped by said error signal from operating.

30. A coin selector for selecting acceptable and unacceptable coins from among coins inserted in a coin passageway, comprising:

an upstream sensor in said coin passageway for discriminating between acceptable coins and unacceptable coins;

a first counter for counting only acceptable coins detected by said upstream sensor;

a downstream sensor for detecting only acceptable coins that have moved a substantial distance downstream beyond said upstream sensor;

a second counter for counting only acceptable coins detected by said downstream sensor;

means between said upstream and downstream sensors for diverting unacceptable coins from said downstream sensor, whereby only acceptable coins pass said downstream sensor; and means for emitting an error signal when the counts of said first and second counters differ from each other by more than a predetermined amount.

* * * * *